US009091998B2

(12) United States Patent
Hashimoto

(10) Patent No.: US 9,091,998 B2
(45) Date of Patent: Jul. 28, 2015

(54) PRINTING APPARATUS, PRINT HEAD CONTROL APPARATUS, PRINT HEAD CONTROL METHOD AND STORAGE MEDIUM

(71) Applicant: CASIO COMPUTER CO., LTD., Shibuya-ku, Tokyo (JP)

(72) Inventor: Jun Hashimoto, Hamura (JP)

(73) Assignees: CASIO ELECTRONICS MANUFACTURING CO., LTD., Iruma-shi, Saitama (JP); CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/275,534

(22) Filed: May 12, 2014

(65) Prior Publication Data

US 2014/0340457 A1 Nov. 20, 2014

(30) Foreign Application Priority Data

May 15, 2013 (JP) ..... 2013-102788

(51) Int. Cl.
*B41J 29/393* (2006.01)
*G03G 21/00* (2006.01)
*B41J 2/205* (2006.01)

(52) U.S. Cl.
CPC ..... *G03G 21/0011* (2013.01); *B41J 2/2054* (2013.01); *B41J 2/2056* (2013.01); *B41J 29/393* (2013.01)

(58) Field of Classification Search
CPC ..... G03G 15/161; G03G 15/168; G03G 2221/0005; G03G 2215/1647; G03G 2221/0026; G03G 21/0011; B41J 2/2054; B41J 2/36; B41J 29/393; B41J 2/2056
USPC ..... 347/19, 54, 118, 14, 15; 399/101, 350
See application file for complete search history.

(56) References Cited

U.S. PATENT DOCUMENTS

| | | | | |
|---|---|---|---|---|
| 7,209,699 | B2 * | 4/2007 | Yamaguchi et al. | 399/346 |
| 8,326,175 | B2 | 12/2012 | Sueoka | |
| 8,712,308 | B2 * | 4/2014 | Ikari et al. | 399/346 |
| 2008/0292361 | A1 * | 11/2008 | Seshita et al. | 399/252 |

FOREIGN PATENT DOCUMENTS

| | | | |
|---|---|---|---|
| JP | 05-040438 | A | 2/1993 |
| JP | 2005-316085 | A | 11/2005 |
| JP | 2011-090134 | A | 5/2011 |

* cited by examiner

*Primary Examiner* — An Do
(74) *Attorney, Agent, or Firm* — Holtz, Holtz, Goodman & Chick PC

(57) ABSTRACT

A printing apparatus includes: a print head; an image carrier; a print controller which controls the print head to execute printing on a recording medium for printing via the image carrier, based on print data; a judgement unit which judges whether a lubricant is to be provided on a surface of the image carrier or not, based on a coverage rate by the print data, wherein the coverage rate is the total number of dots to be printed for an area divided by the total number of dots of the area; and a lubricant controller which controls provision of the lubricant on the surface when the judgement unit judges that the surface is to be provided with the lubricant.

19 Claims, 12 Drawing Sheets

FIG. 7

EXAMPLE OF TOTAL NUMBER OF DOTS: 2256 × 4964

| COVERAGE RATE (%) | THE NUMBER OF DOTS TO BE PRINTED | THE NUMBER OF LINES TO BE DISCHARGED | THE NUMBER OF DOTS TO BE DISCHARGED |
|---|---|---|---|
| 0.0 | 0 | 256 | 577536 |
| 0.5 | 55994 | 238 | 536283 |
| 1.0 | 111988 | 219 | 495031 |
| 1.5 | 167982 | 201 | 453778 |
| 2.0 | 223976 | 183 | 412526 |
| ⋮ | ⋮ | ⋮ | ⋮ |
| 6.0 | 671927 | 37 | 82505 |
| 6.5 | 727921 | 18 | 41253 |
| 7.0 | 783915 | 0 | 0 |

FIG. 8

| No. | OUTPUT IMAGE | COVERAGE RATE (%) |
|---|---|---|
| 1 | | 100 |
| 2 | | 75 |
| 3 | | 75 |
| 4 | | 50 |
| 5 | | 50 |
| 6 | | 50 |
| 7 | | 50 |
| 8 | | 25 |
| 9 | | 25 |
| 10 | | 25 |
| 11 | | 25 |

PRINTING APPARATUS, PRINT HEAD CONTROL APPARATUS, PRINT HEAD CONTROL METHOD AND STORAGE MEDIUM

CROSS-REFERENCE TO RELATED APPLICATION

This application is based upon and claims the benefit of priority from the prior Japanese Patent Application No. 2013-102788, filed May 15, 2013, the entire contents of which are incorporated herein by reference.

FIELD

The present invention relates to a printing apparatus, a print head control apparatus, a print head control method and a storage medium.

BACKGROUND

A method for a printing apparatus such as a printer is widely known in which a toner image formed on a photoreceptor drum is transferred to a recording medium for printout directly or via an intermediate transfer medium. In the printing apparatus employing such the method, toner is sometimes left on a surface of an image carrier which carries the toner image such as the photoreceptor drum or a transfer belt which functions as the intermediate transfer medium even after the toner image is transferred to the recording medium. For this reason, some printing apparatuses are provided with a cleaning mechanism which removes residual toner by a cleaning blade contacting on the surface of the photoreceptor drum or the transfer belt.

In such the cleaning mechanism, when toner at the edge of the cleaning blade is reduced due to a friction force generated between the edge and the contacting surface in a print process, in some cases, the edge is turned up and broken, an abnormal noise such as a chattering noise is generated, or toner passes through. Therefore, toner as a lubricant needs to be provided to the edge of the cleaning blade, and the cleaning blade needs to be protected.

For example, Unexamined Japanese Patent Application Kokai Publication No. 2011-090134 discloses a technique in which toner as the lubricant is sufficiently provided to the edge of the cleaning blade to prevent turn-up or deterioration of the edge, or generation of the abnormal noise, whereby the cleaning blade can attain a stable cleaning performance.

However, the amount of the lubricant needed for lubrication of the surface of the image carrier such as the photoreceptor drum or the intermediate transfer belt varies depending on a printing status. For example, since after performing printing at a high coverage rate, the amount of toner used is large, and the amount of toner left on the image carrier such as the photoreceptor drum or the intermediate transfer belt is also large, the amount of the lubricant needed is smaller than that after performing printing at a low coverage rate. For this reason, there are some cases in which when the same amount of lubricant is used regardless of the printing status, the amount of the lubricant consumed becomes large, thereby increasing running cost of the printing apparatus.

SUMMARY

In one aspect, a printing apparatus of the disclosure is a printing apparatus comprising:

a print head;

an image carrier;

a print controller which controls the print head to execute printing on a recording medium for printing via the image carrier, based on print data;

a judgement unit which judges whether a lubricant is to be provided on a surface of the image carrier or not, based on a coverage rate by the print data, wherein the coverage rate is the total number of dots to be printed for an area divided by the total number of dots of the area; and a lubricant controller which controls provision of the lubricant on the surface when the judgement unit judges that the surface is to be provided with the lubricant.

In one aspect, a print head control apparatus of the disclosure is a print head control apparatus comprising:

a print controller which controls a print head to execute printing on a recording medium for printing via an image carrier, based on print data;

a judgement unit which judges whether a lubricant is to be provided on a surface of the image carrier or not, based on a coverage rate by the print data, wherein the coverage rate is the total number of dots to be printed for an area divided by the total number of dots of the area; and a lubricant controller which controls provision of the lubricant on the surface when the judgement unit judges that the surface is to be provided with the lubricant.

In one aspect, a print head control method of the disclosure is a print head control method comprising:

a print control step which controls a print head to execute printing on a recording medium for printing via an image carrier, based on print data;

a judgement step which judges whether a lubricant is to be provided on a surface of the image carrier or not, based on a coverage rate by the print data, wherein the coverage rate is the total number of dots to be printed for an area divided by the total number of dots of the area; and a lubricant control step which controls provision of the lubricant on the surface when the judgement step judges that the surface is to be provided with the lubricant.

In one aspect, a non-transitory storage medium of the disclosure is a storage medium storing a program which allows a computer to realize:

a print control function which controls a print head to execute printing on a recording medium for printing via an image carrier, based on print data;

a judgement function which judges whether a lubricant is to be provided on a surface of the image carrier or not, based on a coverage rate by the print data, wherein the coverage rate is the total number of dots to be printed for an area divided by the total number of dots of the area; and a lubricant control function which controls provision of the lubricant on the surface when the judgement function judges that the surface is to be provided with the lubricant.

Additional objects and advantages of the disclosure will be set forth in the description which follows, and in part will be obvious from the description, or may be learned by practice of the disclosure. The objects and advantages of the disclosure may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the disclosure, and together with the general description given above and the detailed description of the embodiments given below, serve to explain the principles of the disclosure.

A more complete understanding of this application can be obtained when the following detailed description is considered in conjunction with the following drawings, in which:

FIG. 7 is a diagram illustrating a setting example of the number of lines to be discharged and the number of dots to be discharged according to a coverage rate;

FIG. 8 is a diagram illustrating an example of an output image per scan line unit for generating a discharge pattern;

DETAILED DESCRIPTION

Figure 1:
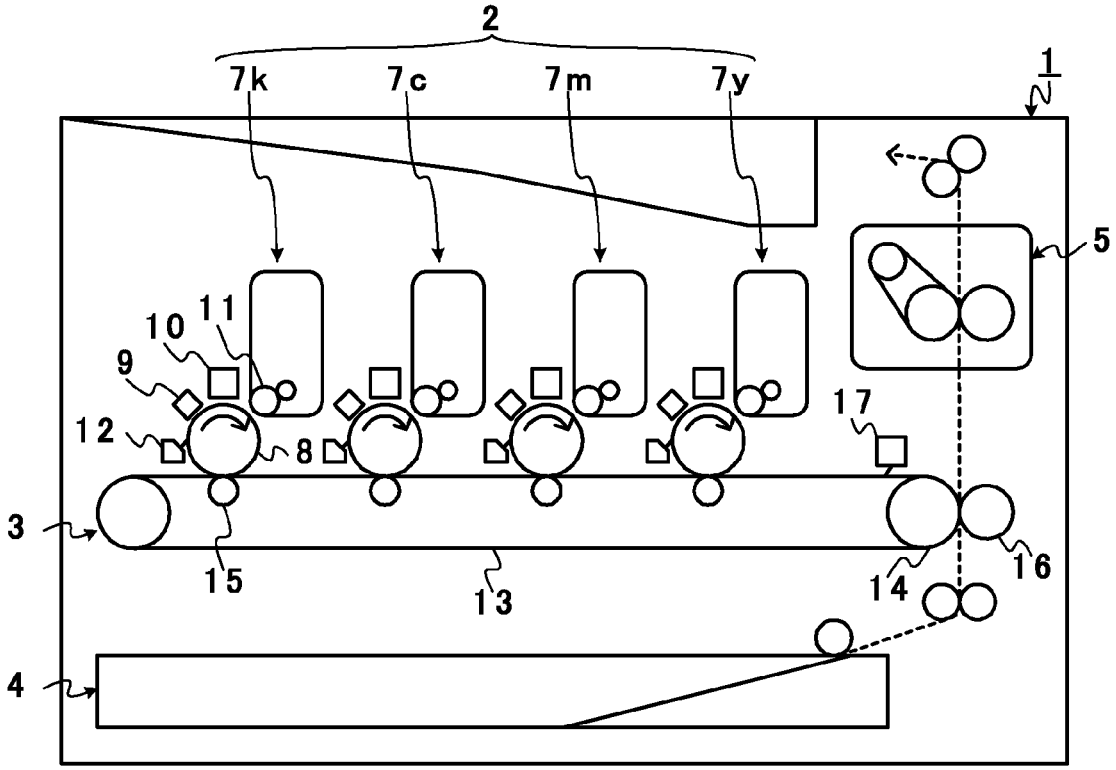
FIG. 1 is a diagram schematically illustrating the overall configuration of a printing apparatus including a print head control apparatus of the present embodiment.

Embodiments of the disclosure will now be described with reference to drawings. In the drawings, the same or corresponding portion is represented by the same reference sign.

The embodiment described below is only for illustration, and not for the purpose of limiting the scope of the disclosure. Therefore, those skilled in the art can employ the embodiment in which the components below are substituted with equivalent ones, and such the embodiment also falls within the scope of the disclosure. In the following description, an explanation of less important known technical matters will be omitted as appropriate for ease of understanding the present disclosure.

FIG. 1 illustrates an overall configuration of a printing apparatus including a print head control apparatus of the present embodiment. In the following, a printing apparatus 1 will be described taking an electrophotographic secondary transfer type tandem color printer as an example. The printing apparatus 1 comprises an image former 2, an intermediate transferer 3, a paper feeder 4, and a fuser 5.

The image former 2 has a configuration in which four image forming units 7 (7*k*, 7*c*, 7*m*, 7*y*) are arranged in series. Three image forming units 7*c*, 7*m*, 7*y* on the upstream (right in FIG. 1) of the four image forming units 7 form a color image created by color toners of cyan (C), magenta (M), yellow (Y) which are three subtractive primary colors, respectively. On the other hand, the image forming unit 7*k* on the downstream (left in FIG. 1) thereof forms a monochrome image created by black (K) toner which is primarily used for a black portion of a pattern (including a character or a symbol) or an image or the like.

Each image forming unit 7 comprises a photoreceptor drum 8 at the bottom. A circumferential surface of the photoreceptor drum 8 comprises, for example, an organic photoconductive material; and the photoreceptor drum 8 carries, on the surface of thereof, a toner image which is to be transferred via a transfer belt 13 mentioned below to a printing paper as a recording medium for printing supplied from the paper feeder 4.

Each image forming unit 7 further comprises: an electrifier 9 for electrifying the surface of the photoreceptor drum 8; a print head 10 for exposing an image light based on print data for which a print request is made on the photoreceptor drum 8; and a developing roller 11 which develops, from an electrostatic latent image formed on the photoreceptor drum 8, the toner image using each color toner by exposure of the print head 10, such that the electrifier 9, the print head 10, and the developing roller 11 surround the photoreceptor drum 8.

Here, the print head 10 comprises an LED array in which a large number of micro-sized LED (Light Emitting Diode) elements is linearly arranged along a main scanning direction (an axis direction of the photoreceptor drum 8). The LED element is driven at an individual driving timing based on the print data, and exposes the uniformly electrified photoreceptor drum 8 with a light emission of the LED element to discharge an electric charge on the surface of the photoreceptor drum 8. By this, the electrostatic latent image corresponding to an exposure image is formed on the photoreceptor drum 8, and the electrostatic latent image is developed by toner which is electrostatically attracted by the developing roller 11, and visualized.

Further, each image forming unit 7 comprises a photoreceptor cleaner 12 which functions as a cleaning mechanism of the photoreceptor drum 8. The photoreceptor cleaner 12 includes a cleaning blade which is arranged along the main scanning direction of the photoreceptor drum 8 such that the cleaning blade contacts on the surface of the photoreceptor drum 8 which is rotatably driven, and adhesion such as residual toner after the toner image is transferred to the transfer belt 13 is swept off and removed with the cleaning blade.

In FIG. 1, references signed are placed only on the configuration of the image forming unit 7*k* for black (K), and all the image forming units 7 have a similar configuration except for the color of the toner stored in each toner container.

The intermediate transferer 3 comprises: the endless transfer belt 13 which extends substantially from the left end to the right end in FIG. 1 in a flat loop shape substantially at the center in the printing apparatus 1; a driving roller 14 over which the transfer belt 13 is stretched and which moves the transfer belt 13 counterclockwise circularly in FIG. 1; four primary transfer rollers 15 corresponding to four image forming units 7*k*, 7*c*, 7*m*, 7*y*; and a secondary transfer roller 16 which is arranged such that the secondary transfer roller 16 is in a pressure contact with the driving roller 14 via the transfer belt 13.

The primary transfer roller 15 comprises an electroconductive foam sponge for applying a pressure on the bottom of the circumferential surface of the photoreceptor drum 8 via the transfer belt 13, and transfers the toner image of each color on the transfer belt 13 in order to form a synthetic image from the toner images of all the colors developed on the photoreceptor drum 8.

The transfer belt 13 carries the toner image which is primarily transferred from the photoreceptor drum 8 by the primary transfer roller 15 on a surface thereof, and conveys the toner image to the position of the secondary transfer roller 16 in order to secondarily transfer the toner image on the printing paper as the recording medium for printing which is supplied from the paper feeder 4. The secondary transfer roller 16 secondarily transfers the toner image on the transfer belt 13 which is conveyed to the position of the secondary transfer roller 16 on the printing paper conveyed from the paper feeder 4.

The intermediate transferer 3 further comprises a transfer belt cleaner 17 which functions as a cleaning mechanism of the transfer belt 13. The transfer belt cleaner 17 includes the cleaning blade which is arranged along a direction perpendicular to a moving direction of the transfer belt 13 such that the transfer belt cleaner 17 is in contact with the surface of the transfer belt 13 which moves circularly, and adhesion such as residual toner after the toner image is secondarily transferred to the printing paper is swept off and removed with the cleaning blade.

The paper feeder 4 is an accommodation member for accommodating the recording medium such as the printing paper for printout (hereinafter, referred to as "printing paper"). The printing paper accommodated in the paper feeder 4 is sequentially conveyed to the position of secondary transfer by a convey roller, and the toner image for which an output request is made is transferred on a surface of the printing paper.

The fuser 5 is arranged on the downstream of the secondary transfer roller 16 (upward in FIG. 1). The fuser 5 comprises a heating roller containing a heater, and a pressure roller which is in pressure contact with the heating roller, and fixes the toner image which is secondarily transferred on the printing paper. The printing paper on which the toner image is fixed by heat is discharged on a paper output tray.

Figure 2:
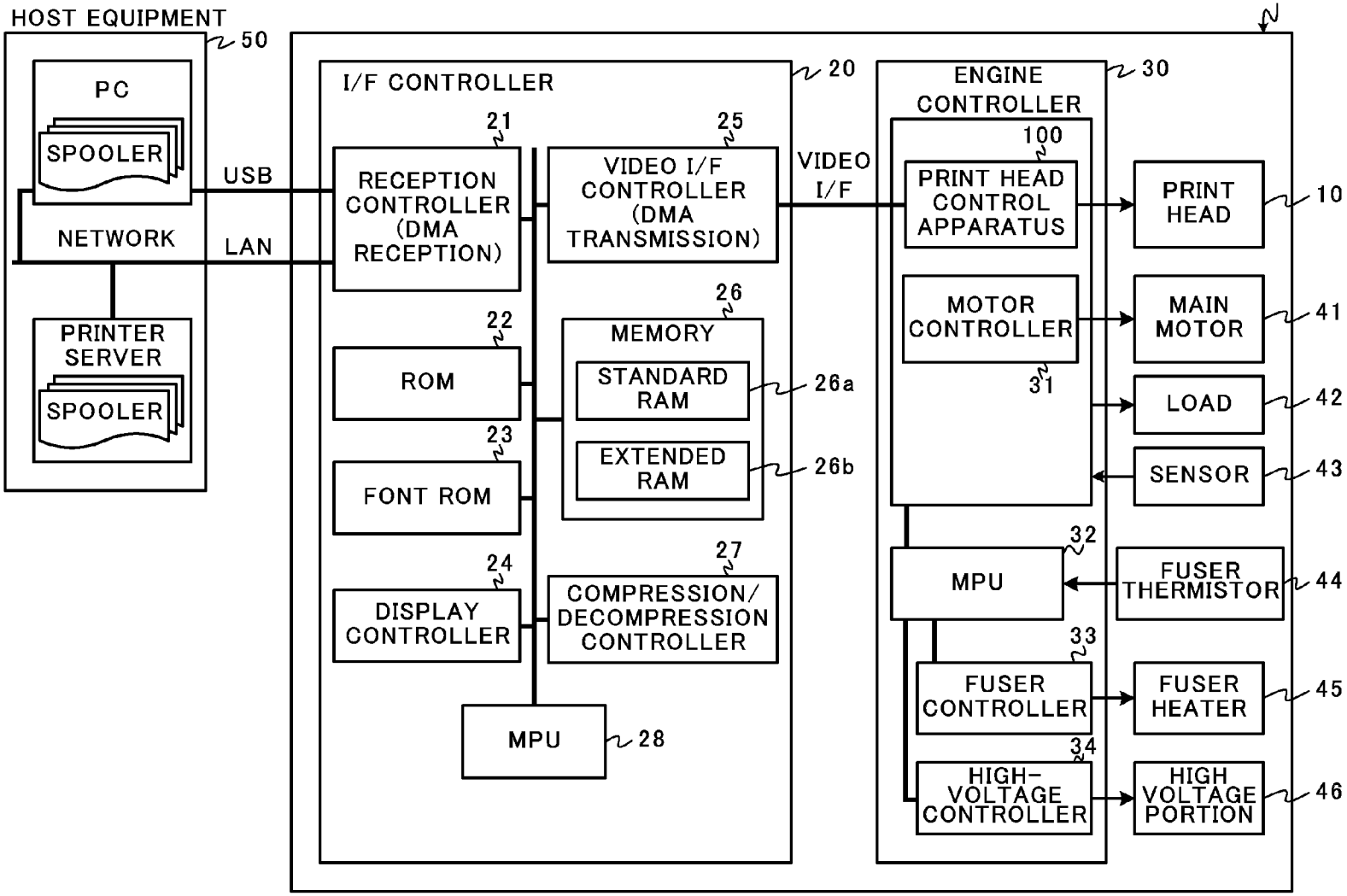
FIG. 2 is a diagram illustrating a control system of a printing apparatus.

Next, a control system of the printing apparatus 1 will be described with reference to FIG. 2.

The printing apparatus 1 comprises an interface controller (hereinafter, referred to as "I/F (Interface) controller") 20, and an engine controller 30, and is connected to a host equipment 50 such as a PC (Personal Computer) or a printer server via LAN (Local Area Network) and USB (Universal Serial Bus).

In the PC, when a user performs a print instruction for an object to be printed via an application, the PC convert the print data of the object to be printed into command data, and temporarily stores the command data in a spooler. In cases in which the PC and the printing apparatus 1 are connected to each other through USB, the command data stored in the spooler is directly transmitted to the printing apparatus 1. On the other hand, in cases in which printing is performed by way of the printer server which is connected to the PC through a network, the command data stored in the spooler in the PC is transferred to the spooler in the printer server, and transmitted to the printing apparatus 1 from the spooler in the printer server.

The I/F controller 20 comprises a reception controller 21, a ROM (Read Only Memory) 22, a font ROM 23, a display controller 24, a video I/F controller 25, a memory 26 (a standard RAM (Random Access Memory) 26*a* and a extended RAM 26*b*), a compression/decompression controller 27, and an MPU (Micro Processing Unit) 28.

The reception controller 21 receives the command data from the host equipment 50, and transfers the command data by DMA (Direct Memory Access) to the memory 26 which functions as a reception buffer. The command data which is transferred to and stored in the memory 26 is analyzed in accordance with the control of the MPU 28, and converted into video data (bit map data), and the video data is drawn on a drawing area of the memory 26.

After one page of drawing of the video data is completed, the video I/F controller 25 instructs the engine controller 30 to start printing. Then, the video data in the drawing area is compressed and decompressed by the compression/decompression controller 27, and transferred from the video I/F controller 25 to the engine controller 30 by DMA in synchronous with a horizontal synchronizing signal (HSYNC) from the engine controller 30 per one scan line.

The video I/F controller 25 also performs specification of an engine such as selection of a paper feeder port or specification of the resolution, or reception of the state of the engine such as jamming. The state of the engine received is notified to the host equipment 50 by the reception controller 21.

The display controller 24 displays a variety of patterns (including a character or a symbol) or images on a display panel such as an LCD (Liquid Crystal Display). The display controller 24 informs the user of the status of the printing apparatus 1 such as remaining toner or printing papers, or jamming by, for example, displaying information representing the status of the printing apparatus 1.

The MPU 28 is connected to each part of the I/F controller 20 via a system bus, and controls the operation thereof. The MPU 28, using the memory 26 as a working memory, reads a control program stored in the ROM 22, a printer font stored in the font ROM 23, or the like, and executes them as appropriate.

On the other hand, the engine controller 30 comprises a print head control apparatus 100, a motor controller 31, an MPU 32, a fuser controller 33, and a high-voltage controller 34.

The motor controller 31 outputs a driving signal to each of a plurality of main motors 41 to rotate the main motor 41 and to convey the printing paper from the paper feeder 4. Then, the motor controller 31 notifies the I/F controller 20 when the end of the printing paper reaches a position where an image can be formed.

Further, the engine controller 30 controls driving of a variety of loads 42 such as a paper feeder solenoid or a standby clutch. Other than the above, the engine controller 30 also receives a detection signal by a variety of sensors 43 which detect the existence of the printing paper, the size of the printing paper, whether a tray is open or not, and the like, and reflects these signals on the control of the print head 10 or the main motor 41.

The MPU 32 obtains information about a detected temperature of a fuser roller which is not illustrated from a fuser thermistor 44 arranged on the above-mentioned fuser 5, and the fuser controller 33 outputs a temperature control signal to a fuser heater 45 arranged on the fuser roller while referring to an obtained detected temperature. Further, the high-voltage controller 34 outputs a high voltage control signal to a high voltage portion 46.

The print head control apparatus 100 controls the print head 10 contained in each of the image forming units 7 (7*k*, 7*c*, 7*m*, 7*y*) for four colors of toner as a print controller, and executes a requested print process. Specifically, when the print head control apparatus 100 is requested to output to the printing paper, the print head control apparatus 100 sends the video data to be output to the print head 10 while controlling timing of the scan line and forms the electrostatic latent image on the photoreceptor drum 8, thereby executing a printout process according to the request.

In addition, as a lubricant controller, the print head control apparatus 100 executes, for each of the photoreceptor drum 8 and the transfer belt 13 which function as an image carrier during print output, a provision process for toner (toner for lubrication) as a lubricant which reduces friction generated at an contacting portion of the cleaning blade with the surface thereof and protects the cleaning blade. Specifically, the print head control apparatus 100 controls the print head 10 at a time when the printout process for the printing paper is not executed, forms the electrostatic latent image on the photoreceptor drum 8, and provides toner for lubrication to a surface of the image carrier, thereby providing toner for lubrication to the contacting portion of the cleaning blade.

The configuration of the print head control apparatus 100 will be described in more detail with reference to FIG. 3.

The print head control apparatus 100 comprises a video I/F controller 101, a video RAM 102, a basic timing generator 103, a CPU I/F 104, and a head I/F controller 110, which are connected to each other via a CPU bus.

The video I/F controller 101 sends and receives a vertical synchronizing signal (VSYNC), the horizontal synchronizing signal (HSYNC), the video data (Video[3:0]), and a video clock signal (VCLK) with the above-mentioned I/F controller 20. For example, the video I/F controller 101 outputs the vertical synchronizing signal and the horizontal synchronizing signal to the I/F controller 20. Then, in response to the output, the I/F controller 20 sends the prescribed number of dots of the video data to the video I/F controller 101 in accordance with the resolution in synchronous with the video clock signal.

The video I/F controller 101 is connected to the video RAM 102, stores the video data received from the I/F controller 20 in the video RAM 102, and transfers the video data to a dot pattern generator 111 according to a request from the dot pattern generator 111.

The basic timing generator 103 divides the video data to be printed in a vertical scanning direction (a direction perpendicular to the main scanning direction) in accordance with preset information, and generates a basic timing depending on a throughput of the print head 10 for each color. A signal such as the above-mentioned horizontal synchronizing signal or a dot clock signal (DCLK) mentioned below is generated in accordance with a variety of timing signals.

The CPU I/F controller 104 performs an address decode and reads/writes a register and an I/O port of each module. In addition, the CPU I/F controller 104 obtains a variety of information which is used for the control of the print head 10 from a head information ROM 10*a* in the print head 10.

The head I/F controller 110 comprises a dot pattern generator 111, a head data transmitter 112, a head control signal generator 113, a strobe signal generator 114, a dot counter 115, a discharge controller 116, and a discharge pattern generator 117.

The dot pattern generator 111 decomposes each dot (each pixel) of the video data provided from the video I/F controller 101 into a plurality of minute pixels based on a gradation value, and generates dot pattern data.

The term "minute pixel" herein refers to a unit obtained by further dividing one pixel into more minute pieces for the purpose of expressing the density of a color. For example, in cases in which the density of each color is expressed in 4-level gradation, each pixel of the video data is divided into three minute pixels in the vertical scanning direction. In this case, the dot pattern generator 111 generates the dot pattern data such that, toner is applied to all of three minute pixels for the pixel whose gradation value is three, in other words, for the pixel which is printed at the maximum density; toner is applied to two minute pixels for the pixel whose gradation value is two; toner is applied to one minute pixel for the pixel whose gradation value is one; and toner is applied to none of three minute pixels for the pixel whose gradation value is zero.

The head data transmitter 112 sequentially transfers the dot pattern data generated by the dot pattern generator 111 to the print head 10 in accordance with the instruction of the dot clock signal of the head control signal generator 113.

The head control signal generator 113 generates a head control signal such as the horizontal synchronizing signal or the dot clock signal in accordance with the variety of timing signals generated by the basic timing generator 103.

The strobe signal generator 114 generates a strobe signal (STROBE-N) which instructs an exposure timing of the print head 10 for the purpose of executing printing in accordance with the dot pattern data generated by the dot pattern generator 111. The print head 10 forms the electrostatic latent image on the surface of the photoreceptor drum 8 by the exposure with the head for a prescribed time in accordance with the strobe signal.

For example, in cases in which the dot pattern data is generated by dividing one pixel into two pieces in the vertical scanning direction, the strobe signal generator 114 generates the strobe signal corresponding to two kinds of timings, subline (1/2) and subline (2/2) since exposure in the vertical scanning direction is needed to be performed twice by shifting timing in order to form an image having one dot length of the scan line. Similarly, in cases in which the dot pattern data is generated by dividing one pixel into three pieces in the vertical scanning direction, the strobe signal generator 114 generates the strobe signal corresponding to three kinds of timings, subline (1/3), subline (2/3) and subline (3/3).

The dot counter 115 counts the total number of dots to be printed of the video data received from the video I/F controller 101 for each color in a minute pixel unit, or in a gradation value unit. Specifically, when the dot counter 115 receives the video data from the video I/F controller 101, the dot counter 115 performs counting per scan line by sequentially adding the gradation value of the received video data to a line counter for each color. After completing one line of process, the dot counter 115 adds one line of count value to a page counter in synchronous with the horizontal synchronizing signal (HSYNC), thereby accumulating the gradation value of the video data for each color.

More specifically, the dot counter 115 includes five counters, counter A to counter E, and counts the total number of dots to be printed in each of five areas A to E in the video data for each color.

Figure 4:
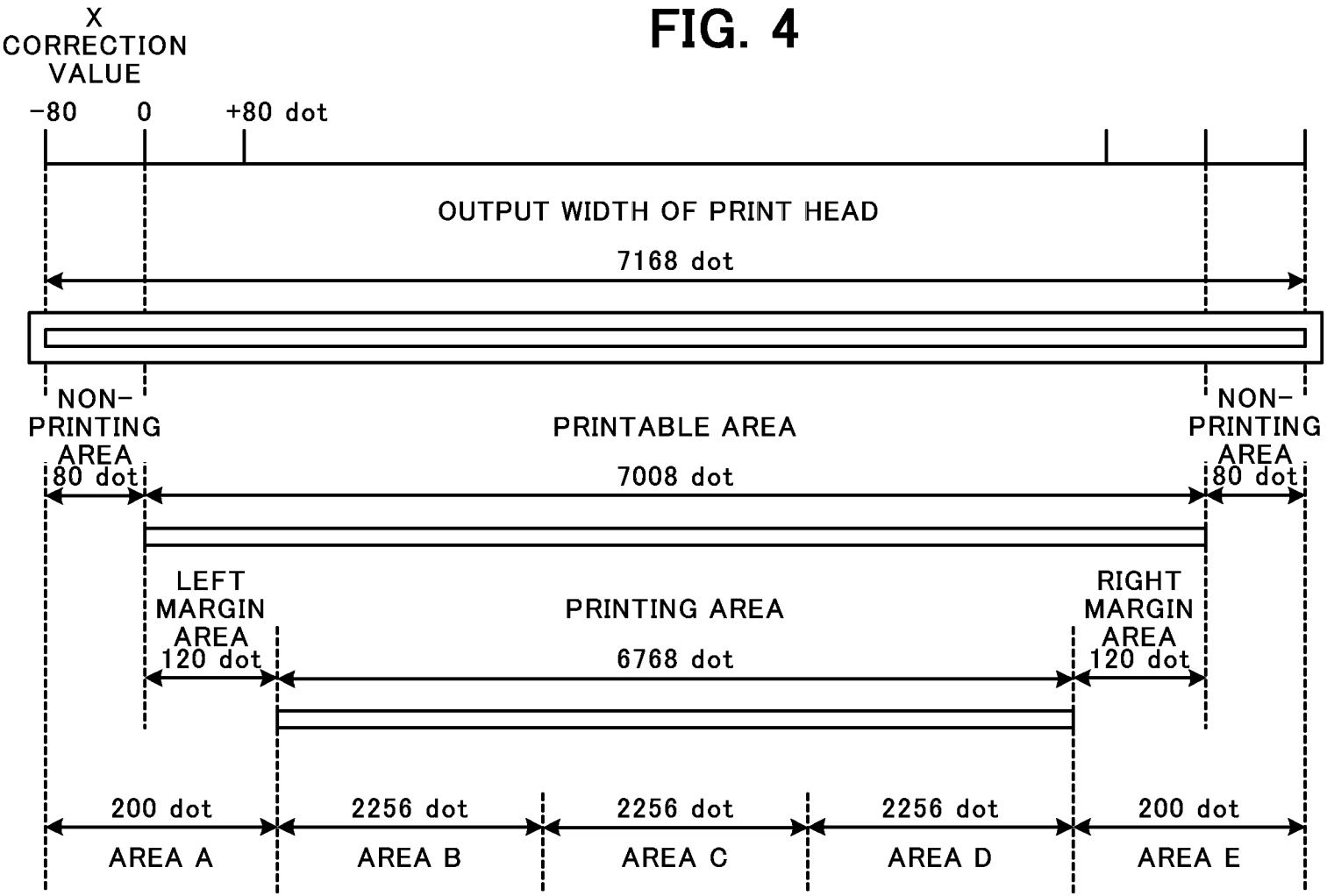
FIG. 4 is a diagram illustrating a setting example of a plurality of areas for dividing video data.
Figure 5:
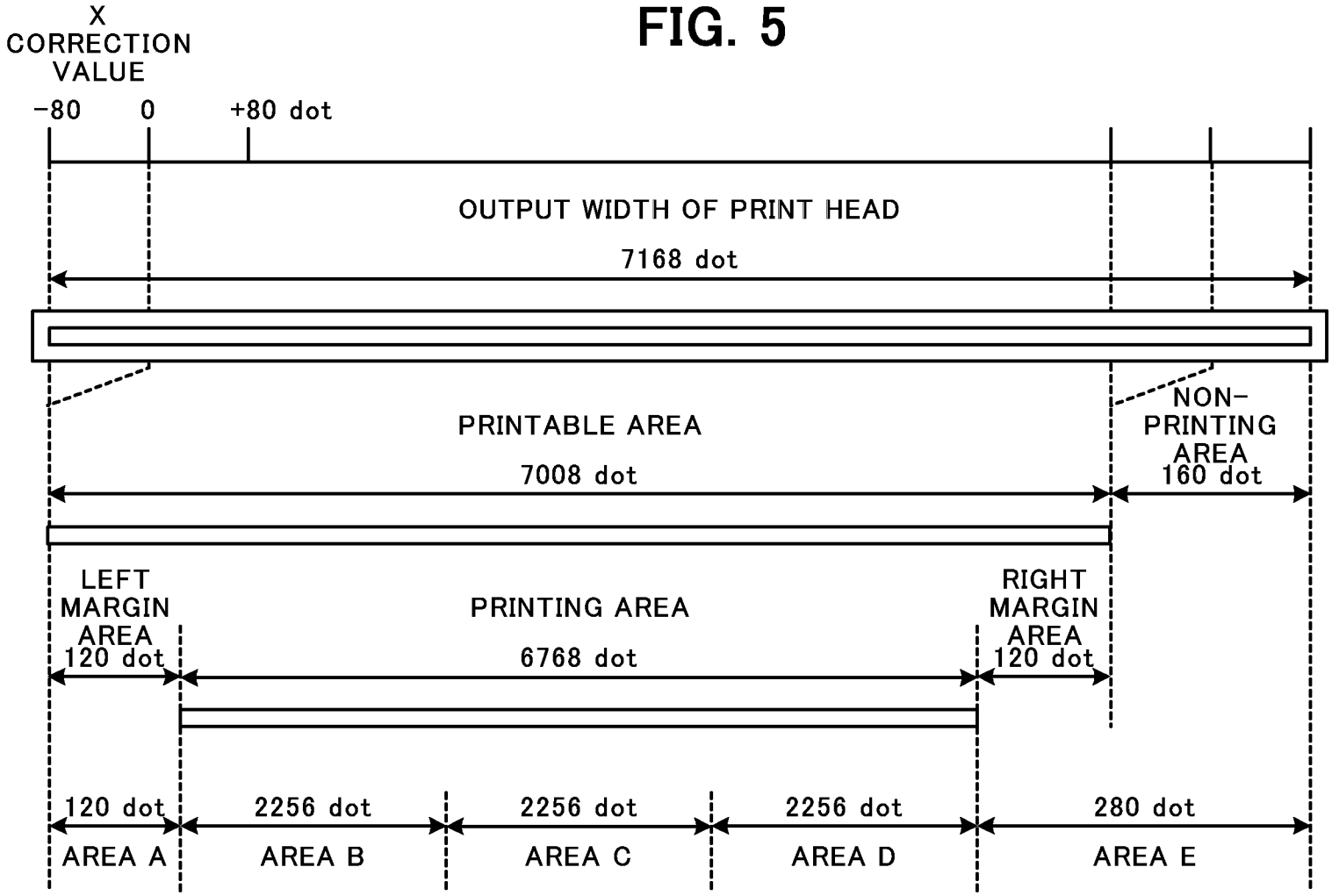
FIG. 5 is a diagram illustrating another setting example of a plurality of areas for dividing video data.
Figure 6:
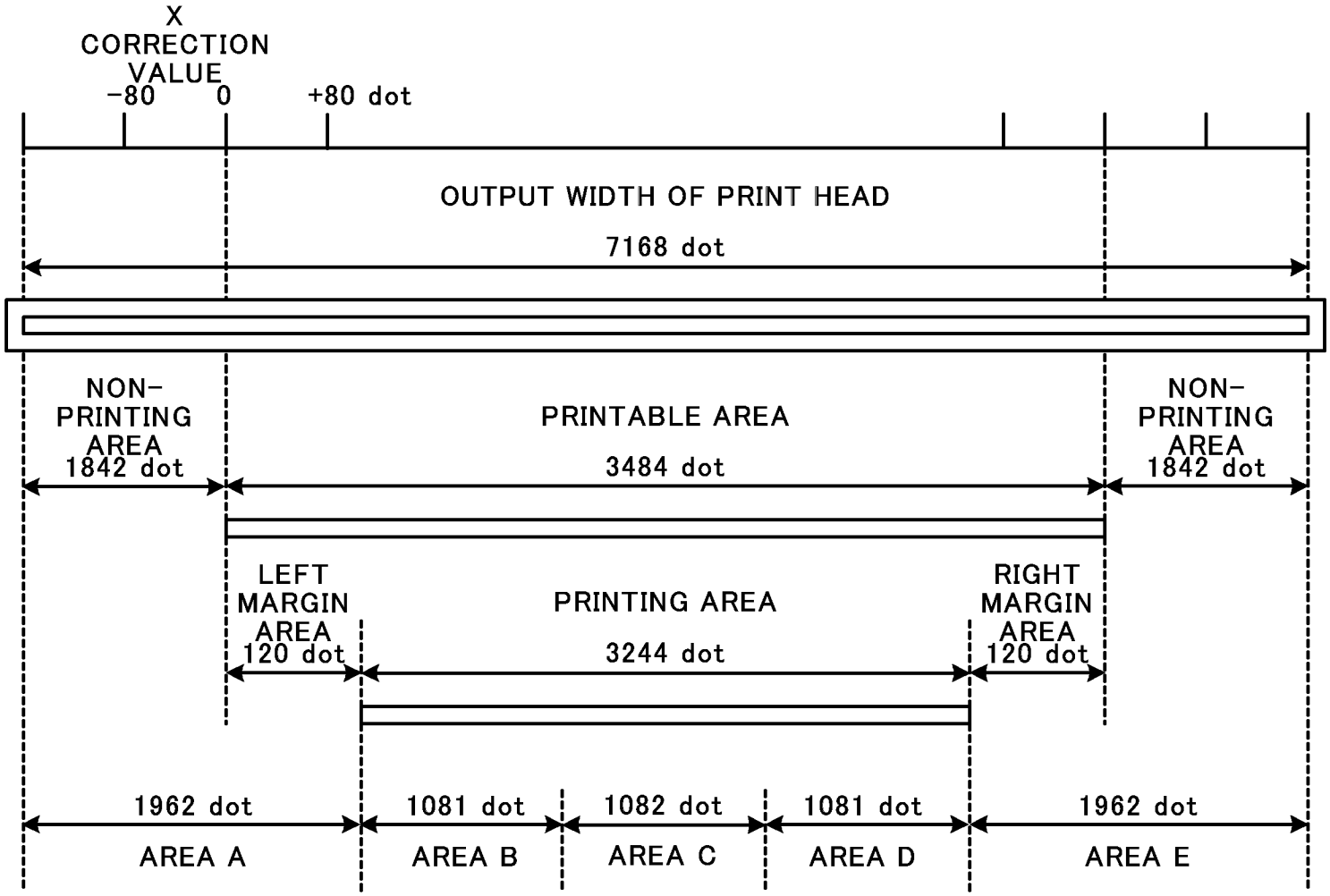
FIG. 6 is a diagram illustrating another setting example of a plurality of areas for dividing video data.

The areas A to E are set such that, for example, as illustrated in FIGS. 4 to 6, the inside in an output width of the print head 10 is divided into five portions. Specifically, when the video data for printout is received from the video I/F controller 101, the dot counter 115 divides the received video data into five areas A to E by boundaries which are set perpendicular to the scan line direction of the video data by the print head 10. Settings of areas A to E will be described with reference to FIGS. 4 to 6. The dot counter 115 functions as a division unit.

In each of FIGS. 4 to 6, the output width of the print head 10 is divided into a printable area and a non-printing area. The printable area is an area where an instructed printing can be executed, and corresponds to a horizontal width of the printing paper which is to be an output destination of the video data. On the other hand, the non-printing area is an area which is other than the printable area in the output width of the print head 10, and corresponds to an area where the video data cannot be output because the area is outside the horizontal width of the printing paper.

For example, FIG. 4 illustrates the setting of areas A to E in cases in which the printing paper having the horizontal width of 7008 dots (for example, an A4 size) is set such that an X correction value is 0, in other words, the printing paper is located at the center in the output width of the print head 10. In this case, the printable area having the horizontal width of 7008 dots corresponding to the horizontal width of the printing paper is set at the center in the output width, and non-printing areas both having 80 dots are set on a right end and a left end within the output width.

The printable area is further divided into a printing area and a margin area. The margin area is an area which is preset as an area where printout is not performed within the horizontal width of the printing paper. In an example of FIG. 4, a left margin area and a right margin area each having 120 dots are set. On the other hand, the printing area is an area of the printable area not including margin areas, and is an area on which the dot pattern data generated by the dot pattern generator 111 is actually printed. In the example of FIG. 4, an area covering 6768 dots is set as the printing area.

As mentioned above, regarding the areas divided in the main scanning direction in the output width of the print head 10, the dot counter 115 sets: a 200 dots of area which is obtained by combining a left non-printing area and the left margin area in FIG. 4 to an area A; three 2256 dots of areas obtained by dividing the printing area into three equal portions to an area B, an area C, and an area D; and a 200 dots of area which is obtained by combining a right non-printing area and the right margin area to an area E.

On the other hand, FIG. 5 illustrates the setting of areas A to E in cases in which the printing paper for printout is arranged such that the position thereof is shifted from the center in the output width of the print head 10. Specifically, FIG. 5 illustrates a state in which the X correction value is set to −80 dots, and the printing paper for printout is arranged being shifted to the left end of output width of the print head 10.

In the case of FIG. 5, since the printing paper is shifted to the left end, there is no non-printing area on the left, and a 160 dots of the non-printing area exists only on the right end in the output width. Due to this, the dot counter 115 sets a 120 dots of area having only the left margin area to an area A, and a 280 dots of area formed on the right end by combining the non-printing area and the right margin area to an area E. The areas B to D are set by dividing the printing area into three equal portions in a similar manner to FIG. 4.

Further, FIG. 6 illustrates the settings of areas A to E, in cases in which the size of the printing paper for printout (3484 dots in the horizontal width, for example, an A5 size) is smaller than the size of the printing papers in FIG. 4 and FIG. 5.

In the case of FIG. 6, since the size of the printing paper is small, large non-printing areas each covering 1842 dots exist on the left and the right in the output width of the print head 10. Due to this, the dot counter 115 sets 1962 dots of areas each obtained by combining the non-printing area with the margin area to an area A and an area E, respectively, and sets areas having 1081 dots or 1082 dots obtained by dividing the printing area into three portions to areas B to D, respectively.

In such a manner, when the video data for printout is received, the dot counter 115 acquires information about the size of the printing paper as the output destination or information about the X correction value, and sets the non-printing area, the margin area, and the printing area in the received video data based on the acquired information. Then, the dot counter 115 divides the received video data into five areas A to E based on the set non-printing area, the margin area, and the printing area. By separating an area obtained by combining the non-printing area and the margin area (area A, area E) from the printing area (area B, area C, area D), an efficiency of provision of toner for lubrication executed for each area can be enhanced.

After dividing the video data into five areas, the dot counter 115 switches areas to be counted from areas A to E according to an enable signal generated by a counter controller, counts the total number of dots to be printed in each of areas A to E in the video data by color, and in the gradation value unit, and calculates the sum of the gradation value for each area and each color. The dot counter 115 functions as a count unit.

Figure 3:
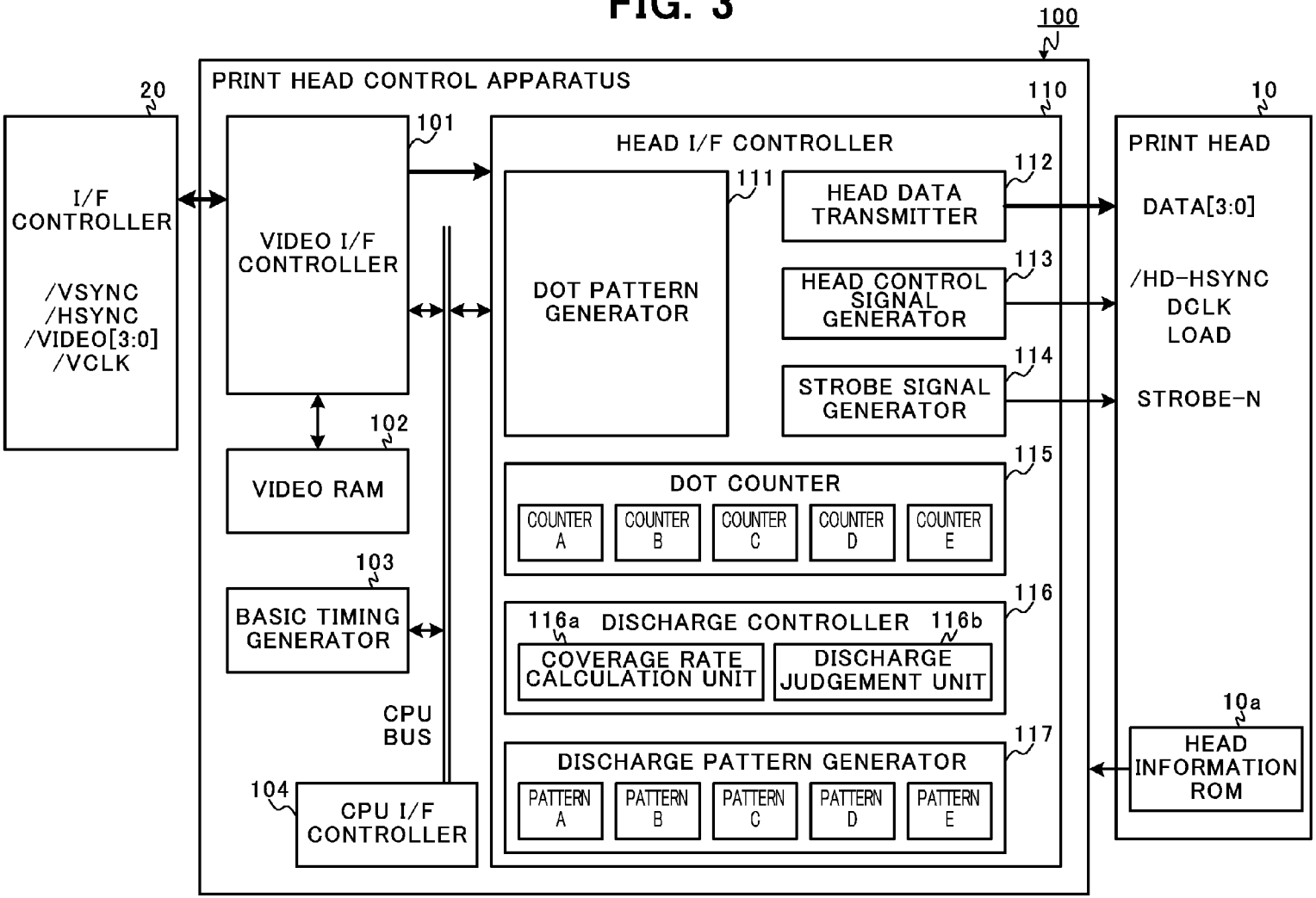
FIG. 3 is a diagram illustrating the configuration of a print head control apparatus of the present embodiment.

Going back to the description of FIG. 3, the discharge controller 116 which the head I/F controller 110 includes, comprises a coverage rate calculation unit 116*a* and a discharge judgement unit 116*b*, and controls the amount of toner which is provided as the lubricant for the photoreceptor drum 8 and the transfer belt 13.

The coverage rate calculation unit 116*a* reads from the dot counter 115 the sum of the gradation value for each color counted at each of the areas A to E, and calculates a coverage rate for each area and for each color. The coverage rate calculation unit 116*a* functions as a calculation unit. The coverage rate is an index representing the printing density at each area (the density of toner image). For example, the coverage rate in cases in which printing is performed across the whole area (the case of so-called solid printing) is 100%; the coverage rate of an area on which printing is not performed at all is 0%. The coverage rate can be obtained by dividing the total number of dots to be printed for each area by the total number of dots for each area, specifically in the following formula:

the coverage rate=the total number of dots to be printed/the total number of dots of area.

Here, the total number of dots for each area is the total number of dots which the whole area has defined by the size and the resolution of each area. For example, the total number of dots of an area having the horizontal width of 2256 dots (corresponding to each of the areas B to D illustrated in FIG. 4) and having a vertical width of 4964 dots is 11198784 (=2256×4964). On the other hand, the total number of dots to be printed is obtained by dividing the sum of the gradation value which the dot counter 115 counts in the corresponding area by the value (three in the case of 4-level gradation) obtained by subtracting one from the maximum number of levels of gradation set for each pixel. For example, in cases in which the density of each color is expressed in an N-level gradation, the total number of dots to be printed is represented by the following formula:

the total number of dots to be printed=the sum of gradation value/($N$−1).

The discharge judgement unit 116*b* judges whether toner for lubrication is to be provided to the photoreceptor drum 8 and the transfer belt 13 each of which is the image carrier carrying the toner image based on the coverage rate calculated by the coverage rate calculation unit 116*a*. The discharge judgement unit 116*b* functions as a judgement unit. Therefore, the discharge judgement unit 116*b* compares the coverage rate calculated by the coverage rate calculation unit 116*a* with a threshold of the coverage rate preset in a threshold register, and judges whether the coverage rate is lower than the threshold or not for each of the areas A to E and for each color. Then, the discharge controller 116*b* sends a discharge ON signal to the discharge pattern generator 117 so that toner for lubrication having a color corresponding to the color of an area whose coverage rate is judged to be lower than the threshold is discharged.

After the discharge ON signal is received from the discharge judgement unit 116*b*, the discharge pattern generator 117 determines the discharge amount of toner for lubrication by the number of lines to be discharged based on the coverage rate calculated by the coverage rate calculation unit 116*a*, and generates a discharge pattern for discharging a determined number of lines of toner to be discharged. For example, the discharge pattern generator 117 generates discharge patterns for the areas A to E as patterns A to E, respectively. The discharge pattern generator 117 functions as a generation unit.

FIG. 7 illustrates a setting example of the number of lines to be discharged in accordance with the coverage rate calculated from the number of dots to be printed in the area having the horizontal width of 2256 dots and the vertical width of 4964 dots, and corresponding number of dots to be discharged. When the coverage rate of some area for some color is judged to be lower than 7% which is the threshold value by the discharge judgement unit 116*b*, the discharge pattern generator 117 determines the number of lines to be discharged such that, for example in accordance with the correspondence relation illustrated in FIG. 7, the lower the coverage rate is, the larger the amount of toner for lubrication to be provided is. Such a correspondence relation between the coverage rate and the number of lines to be discharged is prestored in a register of the number of lines to be discharged in the print head control apparatus 100.

Specifically, when the coverage rate is relatively high even though the coverage rate is lower than 7%, the discharge pattern generator 117 reduces the number of lines to be discharged since the amount of residual toner after printing is assumed to be relatively large. As the result, the amount of toner consumed used for the lubricant is reduced. On the other hand, when the coverage rate is low, the amount of residual toner after printing is assumed to be small, the discharge pattern generator 117 increases the number of lines to be discharged, thereby increasing the amount of toner consumed, used as the lubricant. For example, when the coverage rate of some area is zero, that is, the total number of dots to be printed is zero, the discharge pattern generator 117 sets the number of lines to be discharged of toner to the area to 256 which is the maximum value.

The discharge pattern generator 117 executes such a determination process of the number of lines to be discharged of toner for lubrication for each of the areas A to E and for each of the four colors. Specifically, since the lower an area whose coverage rate is, the larger the amount of toner for lubrication to be provided to an area on the photoreceptor drum 8 corresponding to the area, toner for lubrication can be effectively provided.

After the number of lines to be discharged is determined in such a manner, the discharge pattern generator 117 generates the discharge pattern when toner for lubrication in the amount corresponding to the decided number of lines is discharged on the surface of the photoreceptor drum 8 and the transfer belt 13 each of which is the image carrier for each area and for each color.

FIG. 8 illustrates a setting example of the discharge pattern by the discharge pattern generator 117, by an output image per scan line by the print head 10 and the coverage rate thereof. The discharge pattern generator 117 generates the discharge pattern by selecting from a plurality of output images illustrated in, for example, FIG. 8. Such the discharge pattern is prestored in a discharge pattern register in the print head control apparatus 100.

More specifically, on an area on which toner for lubrication preset on the photoreceptor drum 8 can be discharged, the discharge pattern generator 117 generates the discharge pattern such that, the larger the size of a dischargeable area is, the discharge amount of toner for lubrication per scan line is reduced, in order that toner for lubrication is applied as evenly as possible.

For this purpose, the discharge pattern generator 117 specifies the output image satisfying the following expression, or the output image in which the coverage rate per scan line is higher than a value obtained by dividing the number of lines to be discharged by the number of lines of the dischargeable area among the output image candidates illustrated in FIG. 8 in order to include toner for lubrication in the amount corresponding to the decided number of lines to be discharged in a preset dischargeable area.

the coverage rate of output image≥the number of lines to be discharged/the number of lines in the dischargeable area Then, the discharge pattern generator 117 selects, as the output image constituting the discharge pattern, the output image in which the coverage rate per scan line in the specified output image is the lowest in order that toner for lubrication is distributed on the dischargeable area as evenly as possible.

Figure 9:
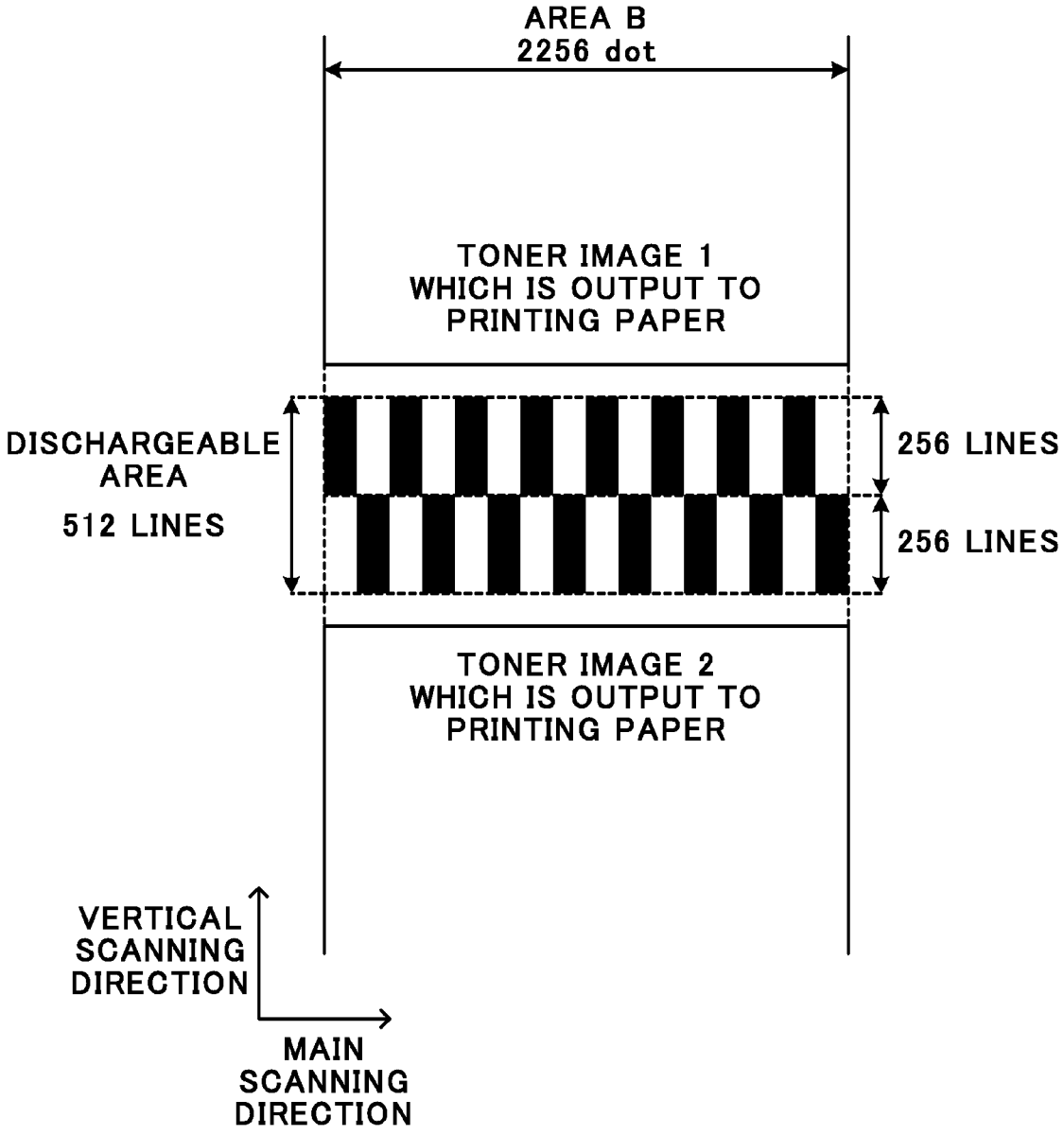
FIG. 9 is a diagram illustrating an example of toner for lubrication discharged on a photoreceptor drum in accordance with a discharge pattern.

FIG. 9 illustrates an example of toner for lubrication discharged in the photoreceptor drum 8 in accordance with the discharge pattern generated by the discharge pattern generator 117. As one example, FIG. 9 illustrates, in the area B having 2256 dots of horizontal width illustrated in FIG. 4, the case in which a 512 lines of the dischargeable area is set between areas on which two toner images 1 and 2 to be output to the printing paper are formed. The discharge pattern generator 117 generates the discharge pattern in which the number of lines to be discharged decided in accordance with the coverage rate is 256 such that the discharge patter is included in the dischargeable area having a length of 512, by combining the output images No. 4 and No. 5 each of whose coverage rate per one line is 50% as illustrated in FIG. 8. Further, by combining a plurality of discharge patterns having the same coverage rate, a memory phenomenon (a burn-in) of the photoreceptor drum 8 generated when one discharge pattern continues can be reduced.

The operation of the above-mentioned print head control apparatus 100 will be described with reference to a flowchart illustrated in FIG. 10.

Figure 10:
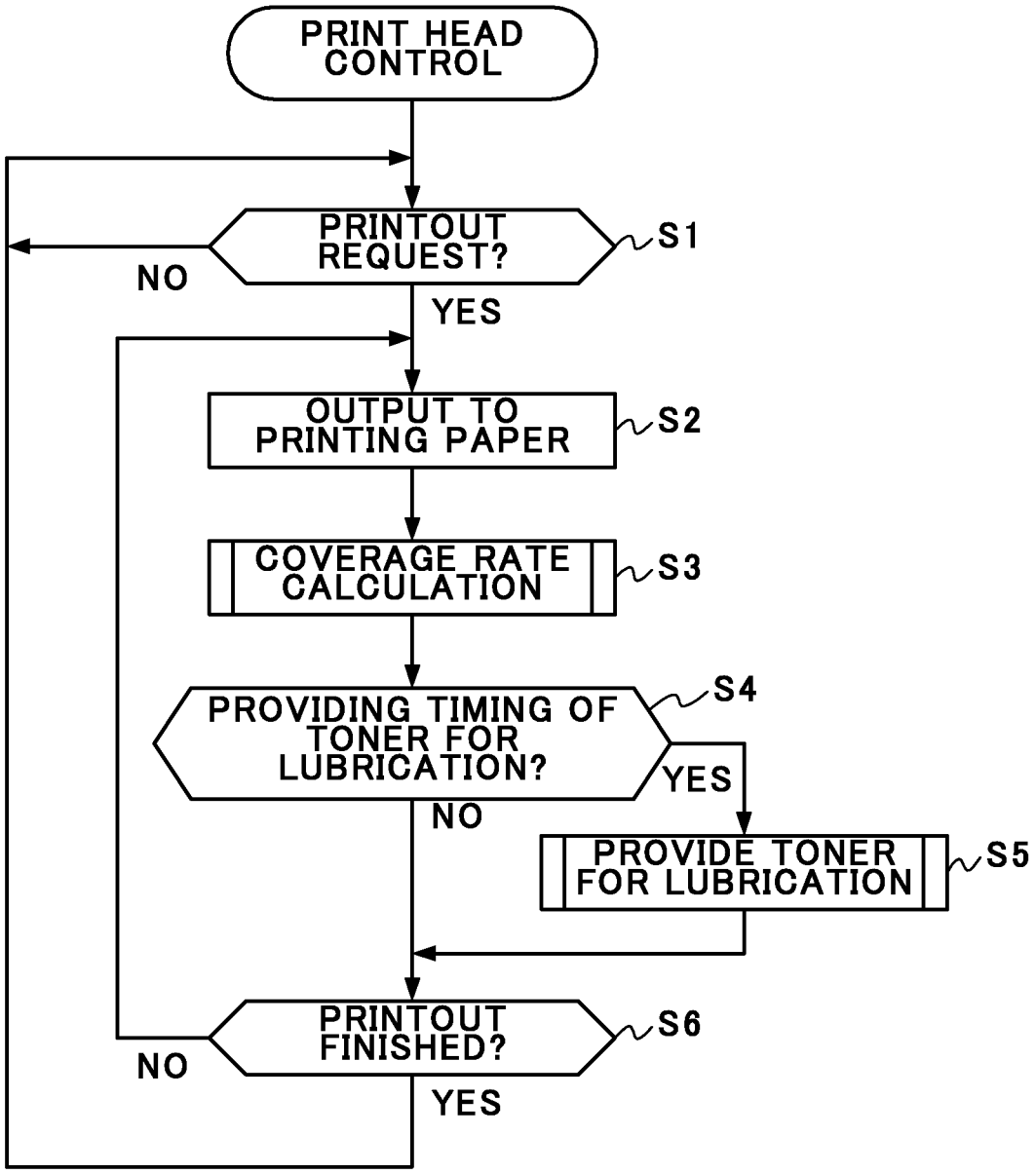
FIG. 10 is a flowchart illustrating a flow of processes to be executed by a print head control apparatus of the present embodiment.

In the flowchart illustrated in FIG. 10, the print head control apparatus 100 determines whether printout on the printing paper is requested or not by determining whether the video I/F controller 101 has received the video data for printout in synchronous with a video clock signal from the I/F controller 20 or not (step S1).

In cases in which printout is not requested (step S1; NO), the print head control apparatus 100 waits until printout is requested in step S1.

When printout is requested (step S1; YES), the print head control apparatus 100 controls the print head 10 which each of the image forming units 7(7*k*, 7*c*, 7*m*, 7*y*) for four colors of toner in accordance with the request, and outputs to the printing paper supplied from the paper feeder 4 (step S2). In other words, the dot pattern generator 111 generates the dot pattern data in accordance with the received video data, synchronizes the generated dot pattern data with the dot clock signal, and transfers the generated dot pattern data from the head data controller 112 to the print head 10 sequentially.

While outputting to the printing paper, the print head control apparatus 100 calculates the coverage rate of the printout (step S3). The detail of the calculation process of the coverage rate will be described with reference to a flowchart of FIG. 11.

Figure 11:
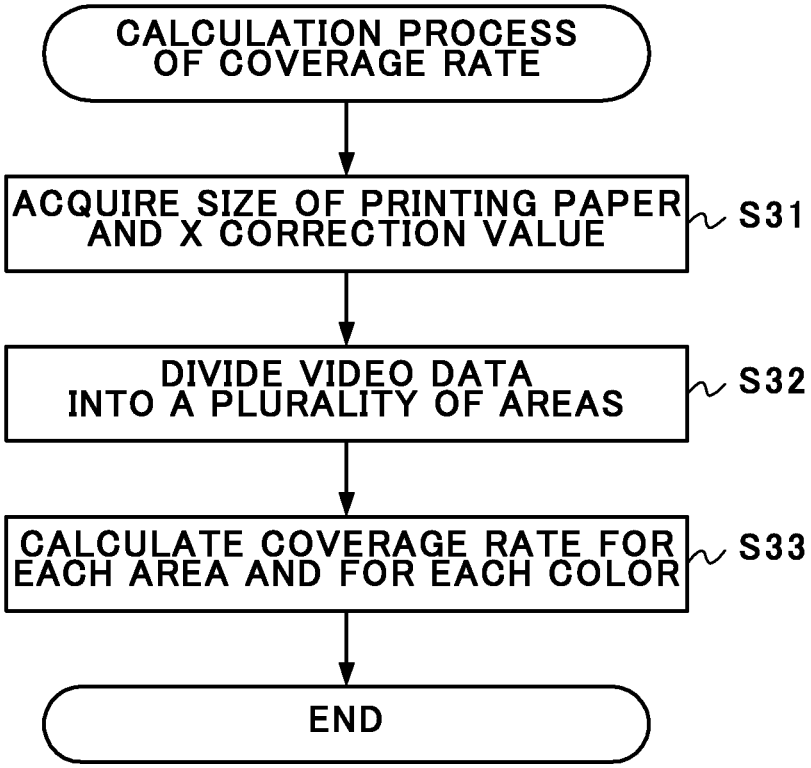
FIG. 11 is a flowchart illustrating a flow of calculation processes of a coverage rate.

In the flowchart of FIG. 11, the dot counter 115 acquires the size of the printing paper and the X correction value during printout (step S31), and divides the received video data into a plurality of areas (step S32). For example, as illustrated in FIGS. 4 to 6, the print head control apparatus 100 sets the non-printing area, the margin area, and the printing area based on the size of the printing paper and the X correction value, and divides the video data into five areas A to E.

After the video data is divided into the plurality of areas, the dot counter 115 counts the total number of dots to be printed for each of the divided areas and for each color, and the coverage rate calculation unit 116*a* calculates the coverage rate on each area and for each color based on the counted total number of dots to be printed (step S33). Then, the calculation process of the coverage rate illustrated in FIG. 11 ends.

Going back to the flowchart of FIG. 10, after calculating the coverage rate during printout, the print head control apparatus 100 judges whether the providing timing of toner for lubrication is come or not (step S4).

The providing timing of toner for lubrication is the timing which is set as the timing when toner for lubrication is to be provided to the photoreceptor drum 8 and transfer belt 13 for the purpose of protecting the cleaning blade. As the providing timing, an interval timing between output processes to the printing paper, for example, per one page or several pages of output process of the printing paper, in order that the toner image to be output to the printing paper and toner for lubrication do not overlap with each other on the photoreceptor drum 8.

When the providing timing of toner for lubrication is come (step S4; YES), the print head control apparatus 100 provides toner for lubrication to the photoreceptor drum 8 and transfer belt 13 (step S5). The detail of the provision process of toner for lubrication will be described with reference to a flowchart of FIG. 12.

Figure 12:
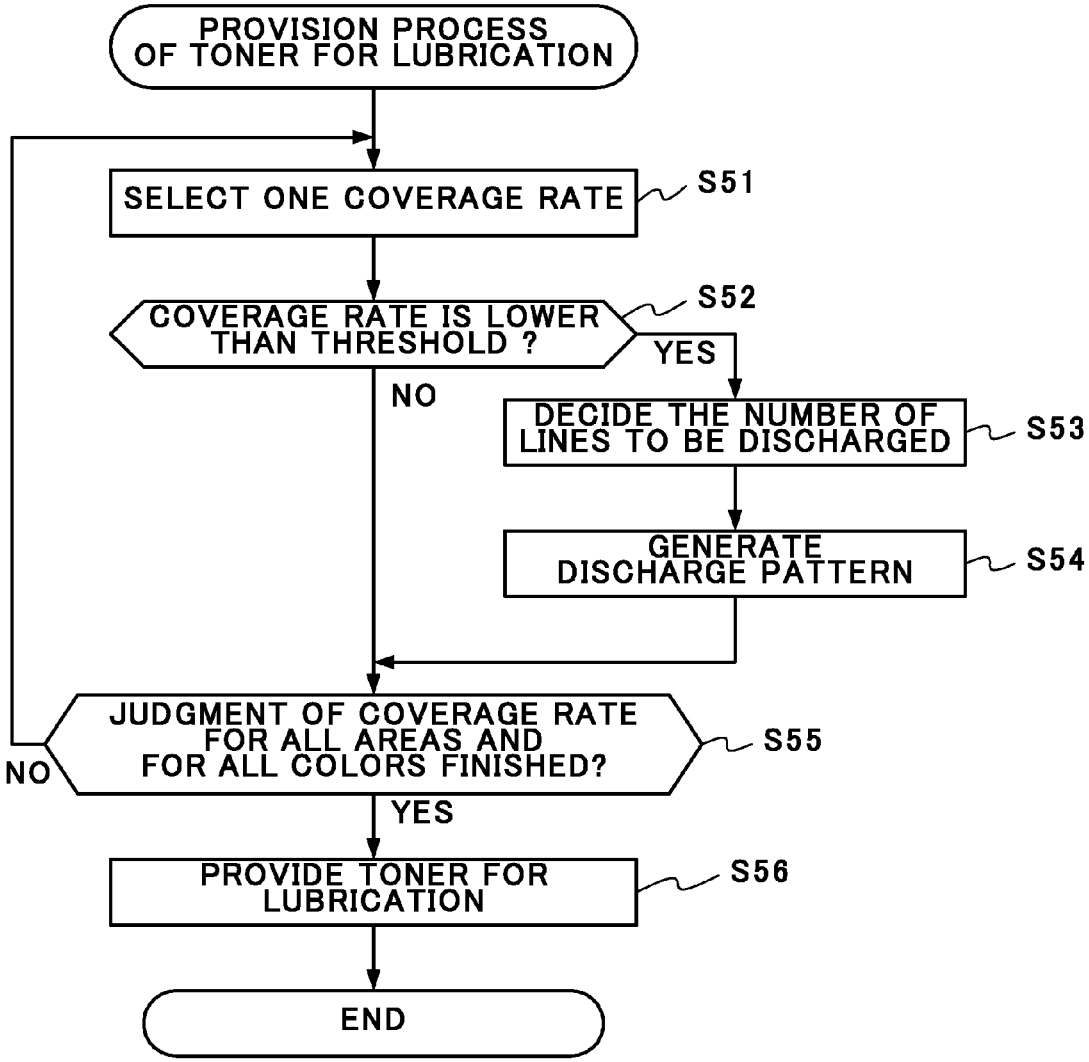
FIG. 12 is a flowchart illustrating a flow of provision processes of toner for lubrication.

In the flowchart of FIG. 12, the discharge judgement unit 116*b* selects one of coverage rates calculated for each of the plurality of divided areas and for each color (step S51), and judges whether the selected coverage rate is lower than the threshold which is preset as a reference value for providing toner for lubrication or not (step S52).

When the selected coverage rate is lower than the threshold (step S52; YES), the discharge pattern generator 117 determines the number of lines to be discharged for discharging toner for lubrication having a color corresponding to the color of an area on which the coverage rate is judged on the photoreceptor drum 8 (step S53). In other words, the print head control apparatus 100 determines the number of lines to be discharged of toner for lubrication such that, the lower the coverage rate is, the larger the amount of toner for lubrication provided is in accordance with the correspondence relation illustrated in the above-mentioned FIG. 7.

After the number of lines to be discharged of toner for lubrication is decided, the discharge pattern generator 117 generates the discharge pattern when the decided number of lines to be discharged of toner for lubrication is discharged (step S54). In other words, the discharge pattern generator 117 generates the discharge pattern such that the number of lines to be discharged of toner for lubrication which is selected from the above-mentioned discharge patterns illustrated in FIG. 8 and decided is included in the dischargeable area on the photoreceptor drum 8.

On the other hand, when the selected coverage rate is not lower than the threshold (step S52; NO), processes of steps S53 and S54 by the discharge pattern generator 117 are not executed. In other words, in order to reduce the amount of toner for lubrication, the print head control apparatus 100 does not execute the provision process of toner for lubrication having a color corresponding to the color of an area on which the coverage rate is judged to be not lower than the threshold.

After processes related to the coverage rates selected in steps S52 to S54 are executed, the discharge judgement unit 116*a* judges whether judgments of the coverage rates of all areas and all colors are finished or not (step S55).

When judgments of the coverage rates of all areas and all colors are not finished (step S55; NO), the print head control apparatus 100 selects another coverage rate from the coverage rates calculated for each of the plurality of areas and for each color in step S51, and executes the processes in steps S52 to S54 for the selected coverage rate. As mentioned above, the print head control apparatus 100 executes judgment processes of the coverage rate for all areas and for all colors, and repeats the processes of steps S51 to S54 until discharge patterns for colors corresponding to all areas on which the coverage rate is judged to be lower than the threshold are finished being generated.

Finally, when judgment of the coverage rate for all areas and for all colors is finished (step S55; YES), the print head control apparatus 100 provides toner for lubrication in accordance with the generated discharge pattern (step S56). Then, the provision process of toner for lubrication illustrated in FIG. 12 ends.

Going back to the flowchart of FIG. 10, when toner for lubrication is provided or in cases in which the providing timing of toner for lubrication is not come in step S4 (step S4; NO), the print head control apparatus 100 judges whether the requested printout is finished or not (step S6).

When the requested printout is not finished (step S6; NO), the print head control apparatus 100 executes processes of steps S2 to S5 again until the requested printout is finished. On the other hand, when the requested printout is finished (step S6; YES), the print head control apparatus 100 waits until a new request for printout is received in step S1.

As described above, the print head control apparatus 100 of the present embodiment calculates the coverage rate during printout, and controls the amount of toner for lubrication to be provided for the purpose of protecting the cleaning blade arranged on the photoreceptor drum 8 or the transfer belt 13 based on the calculated coverage rate. As a result, by preventing unneeded discharge of toner which functions as the lubricant, toner for lubrication can be provided efficiently on the required portion while reducing the running cost of the printing apparatus 1.

MODIFIED EXAMPLE

In the above, the embodiment of the disclosure is described, the components of the above-described embodiment can be freely combined. The above-described embodiment is only for illustration, and the disclosure is not restricted thereto. In other words, the embodiment of the disclosure can be variously applied, and every possible embodiment is within the scope of the disclosure.

For example, in the above-described embodiment, cleaning blades are arranged on both the photoreceptor drum 8 and the transfer belt 13. Further, in the print head control apparatus 100 of the embodiment, both the photoreceptor drum 8 and the transfer belt 13 are provided with toner for lubrication. However, in the disclosure, the cleaning blade may be provided only on one of the photoreceptor drum 8 and the transfer belt 13; and a destination member for print head control apparatus 100 to provide toner for lubrication may be either the photoreceptor drum 8 or the transfer belt 13. Which of the photoreceptor drum 8 and the transfer belt 13 is set to the destination for providing toner for lubrication can be controlled by switching execution/stop of primary transferring of the primary transfer roller 15 by, for example, switching on/off of a primary bias.

In the above-described embodiment, the printing apparatus 1 is the color printer comprising the image forming units 7 (7*k*, 7*c*, 7*m*, 7*y*) corresponding to four colors, cyan (C), magenta (M), yellow (Y), and black (K). Due to this, the print head control apparatus 100 in the above-mentioned embodiment calculates the coverage rate for each color, and controls the amount of toner for lubrication to be provided based on the coverage rate for each color. However, the disclosure can also be applied to the monochrome printer comprising the image forming unit which only deals with one color. Since, in such the monochrome printer, there is no need to control the amount of toner for lubrication to be provided for each color, the above-mentioned effects can be obtained with a simpler constitution.

In the above-described embodiment, five areas A to E are set for the dot counter 115 to calculate the sum of gradation values. However, the disclosure is not limited thereto, and the area may be set in any manner. Although, in the above-described embodiment, the printing area is equally divided into three areas to set areas B to D, for example, taking into account the characteristics of the printing paper, an area whose coverage rate is predicted to be high may be set to be divided into smaller areas.

Although, in the above-described embodiment, for the threshold of the coverage rate, a fixed value, for example, 7% is set for each area and for each color, the threshold of the coverage rate may be set for each area and each color independently.

Although, in the above-described embodiment, toner (toner for lubrication) is used as the lubricant for protecting the cleaning blade, the lubricant is not limited to toner (toner for lubrication), and other lubricants may be used.

As a matter of course, the print head control apparatus comprising a constitution which can carry out the function of the disclosure can be provided. Also, an existing information equipment can be functioned as the print head control apparatus of the disclosure by applying a program. Specifically, by applying the program for carrying out each function configuration by the print head control apparatus 100 illustrated in the above-described embodiment such that the CPU or the like which controls existing information equipment can execute the program, the existing information equipment can be functioned as the print head control apparatus of the disclosure. A print head control method of the disclosure can be carried out by using the print head control apparatus.

Such the program can be applied in any manner. For example, the program can be applied by storing the program in a computer-readable storage medium such as a flexible disc, a CD (Compact Disc)-ROM, a DVD (Digital Versatile Disc)-ROM, or a memory card. Further, the program can be applied by superimposing the program on a carrier wave and transmitting the program via a communications media such as the Internet. For example, the program may be distributed by posting the program on a Bulletin Board System (BBS) on a communications network. Then, the above-described process can be executed by starting up the program and executing the program in a similar manner to other application programs under the control of an OS (Operating System).

Having described preferred embodiments of the disclosure, the disclosure is not limited to the specific embodiment, and the disclosure includes the scope of the claims and its equivalence.

What is claimed is:

1. A print apparatus comprising:

a print head;

an image carrier;

a print controller which controls the print head to execute printing on a recording medium via the image carrier based on print data;

a divider which divides the print data into a plurality of areas by boundaries perpendicular to a direction of a scan line of the print head;

a calculator which calculates a coverage rate for each of the plurality of areas by dividing a total number of dots to be printed in the area by a total number of printable dots for the area; and a judger which judges, for each of the plurality of areas, whether or not a lubricant is to be provided on a surface of the image carrier based on the calculated coverage rate for the area.

2. The print apparatus according to claim 1, further comprising a lubricant controller which controls, with respect to each of the plurality of areas, an amount of the lubricant that is to be provided on the surface, based on the calculated coverage rate for the area.

3. The print apparatus according to claim 2, wherein the lubricant controller controls the amount of the lubricant that is to be provided such that the smaller the coverage rate, the larger the amount of the lubricant that is provided on the surface for the area.

4. The print apparatus according to claim 2, wherein the lubricant controller controls provision of the lubricant on the surface of the image carrier by controlling the print head when the printing by the print controller is not being performed.

5. The print apparatus according to claim 2, wherein the print head is provided for each of a plurality of printed colors; and wherein the lubricant controller controls provision of the lubricant for each of the plurality of printed colors.

6. The print apparatus according to claim 1, further comprising a counter that, if the print data comprises a plurality of gradation values, sums up gradation values for each dot to be printed, for each of the plurality of areas; and wherein the total number of dots to be printed for each of the plurality of areas is calculated based on a total value for each area calculated by the counter.

7. The print apparatus according to claim 1, wherein the divider sets boundary positions based on a size of the recording medium and a setting position of the recording medium in the direction perpendicular to the direction of the scan line so as to divide the print data.

8. The print apparatus according to claim 1, wherein the lubricant comprises a toner used for the printing.

9. The print apparatus according to claim 1, wherein the divider divides the print data such that areas for which the coverage rate is forecast to be high are more finely divided.

10. A non-transitory computer readable storage medium having stored thereon a program for a computer of a print apparatus comprising a print head and an image carrier, the program causing the computer to perform functions comprising:

controlling the print head to execute printing on a recording medium via the image carrier based on print data, dividing the print data into a plurality of areas by boundaries perpendicular to a direction of a scan line of the print head;

calculating a coverage rate for each of the plurality of areas by dividing a total number of dots to be printed in the area by a total number of printable dots for the area; and judging, for each of the plurality of areas, whether or not a lubricant is to be provided on a surface of the image carrier based on the calculated coverage rate for the area.

11. A print apparatus comprising:

a print head;

an image carrier;

a divider which divides print data for the print head, for printing on a recording medium via the image carrier, into a plurality of areas by boundaries perpendicular to a direction of a scan line of the print head;

a calculator which calculates a coverage rate for each of the plurality of areas by dividing a total number of dots to be printed in the area by a total number of printable dots for the area; and a judger which judges, for each of the plurality of areas, whether or not a lubricant is to be provided on a surface of the image carrier based on the calculated coverage rate for the area.

12. The print apparatus according to claim 11, further comprising a lubricant controller which controls, with respect to each of the plurality of areas, an amount of the lubricant that is to be provided on the surface, based on the calculated coverage rate for the area.

13. The print apparatus according to claim 12, wherein the lubricant controller controls the amount of the lubricant that is to be provided such that the smaller the coverage rate, the larger the amount of the lubricant that is provided on the surface for the area.

14. The print apparatus according to claim 12, wherein the lubricant controller controls provision of the lubricant on the surface of the image carrier by controlling the print head when the printing of the print data is not being performed.

15. The print apparatus according to claim 12, wherein the print head is provided for each of a plurality of printed colors; and wherein the lubricant controller further controls provision of the lubricant for each of the plurality of printed colors.

16. The print apparatus according to claim 11, further comprising a counter that, if the print data comprises a plurality of gradation values, sums up gradation values for each dot to be printed, for each of the plurality of areas; and wherein the total number of dots to be printed for each of the plurality of areas is calculated based on a total value for each area calculated by the counter.

17. The print apparatus according to claim 11, wherein the divider sets boundary positions based on the a size of the recording medium and a setting position of the recording medium in the direction perpendicular to the direction of the scan line so as to divide the print data.

18. The print apparatus according to claim 11, wherein the lubricant comprises a toner used for the printing.

19. The print apparatus according to claim 11, wherein the divider divides the print data such that areas for which the coverage rate is forecast to be high are more finely divided.

* * * * *

UNITED STATES PATENT AND TRADEMARK OFFICE

CERTIFICATE OF CORRECTION

PATENT NO. : 9,091,998 B2
APPLICATION NO. : 14/275534
DATED : July 28, 2015
INVENTOR(S) : Hashimoto It is certified that error appears in the above-identified patent and that said Letters Patent is hereby corrected as shown below:

In the claims

Column 18, claim 17, line 2, delete “the a” and insert --the--.

Signed and Sealed this
Twenty-sixth Day of January, 2016

Michelle K. Lee

Michelle K. Lee
*Director of the United States Patent and Trademark Office*